US005454752A

United States Patent [19]

Sexton et al.

[11] Patent Number: 5,454,752

[45] Date of Patent: Oct. 3, 1995

[54] ABRASIVE DEVICE

[76] Inventors: John S. Sexton, Bobcat, West Street, Odiham, Hampshire; Derek N. Wright, 5 Eagle Close, Heathlake Park, Crowthorne Berkshire, both of United Kingdom

[21] Appl. No.: 152,402

[22] Filed: Nov. 15, 1993

[30] Foreign Application Priority Data

Nov. 13, 1992 [GB] United Kingdom ..... 9223826

[51] Int. Cl.[6] ..... B24D 7/06

[52] U.S. Cl. ..... 451/548; 451/542

[58] Field of Search ..... 451/527, 530, 451/542, 548

[56] References Cited

U.S. PATENT DOCUMENTS

| | | | |
|---|---|---|---|
| 2,000,772 | 5/1935 | McGill | 451/542 |
| 2,032,362 | 3/1936 | Herman | 451/542 |
| 2,188,365 | 12/1937 | Lent et al. . | |
| 2,225,193 | 12/1940 | Benner et al. | 451/542 |
| 3,386,214 | 6/1968 | Shoemaker | 451/540 |
| 3,517,466 | 6/1970 | Bouvier | 451/540 |
| 3,913,279 | 10/1975 | Broïdo | 451/540 |
| 5,020,283 | 6/1991 | Tuttle . | |
| 5,137,543 | 8/1992 | Heath et al. | 51/298 |
| 5,167,673 | 12/1992 | Jones | 51/295 |
| 5,218,949 | 6/1993 | Tomlinson et al. | 125/21 |
| 5,247,765 | 9/1993 | Quintana | 451/548 |
| 5,314,512 | 5/1994 | Sexton | 51/293 |

FOREIGN PATENT DOCUMENTS

| | | |
|---|---|---|
| 62015080 | 1/1987 | Japan . |
| 984852 | 12/1983 | U.S.S.R. . |
| 92/05014 | 4/1992 | WIPO . |

*Primary Examiner*—Maurina T. Rachuba
*Attorney, Agent, or Firm*—Scully, Scott, Murphy & Presser

[57] ABSTRACT

The abrasive polishing device has a carrier, typically in the form of a rotatable polishing head (10) and abrasive polishing pads (16) mounted on the carrier. Each polishing pad (16) includes an abrasive body (18) which is provided by a thermoplastic polymer impregnated with ultrahard abrasive particles and which presents an abrasive polishing surface for performing an abrasive polishing action in use. The abrasive body (18) is formed with a regular array of recesses, typically narrow capillarytype passages therein which extend to the abrasive surface. The recesses result in improved cooling of the abrasive layer during a polishing operation.

13 Claims, 1 Drawing Sheet

ABRASIVE DEVICE

BACKGROUND TO THE INVENTION

This invention relates to abrasive polishing devices.

Conventionally, polishing of materials such as granite and marble is achieved using a polishing apparatus that has a rotating polishing head on which a number of polishing pads, typically with wear surfaces of silicon carbide, are mounted. The problem with the conventional polishing apparatuses of this kind is that the wear surfaces are rapidly worn down and require frequent replacement.

SUMMARY OF THE INVENTION

According to the present invention there is provided an abrasive polishing device comprising a carrier and at least one abrasive polishing pad mounted on the carrier, the pad including an abrasive body which is provided by a thermoplastic polymer impregnated with ultra-hard abrasive particles and which presents an abrasive polishing surface for performing an abrasive polishing action in use, the abrasive body being formed with a regular array of recesses therein which extend to the abrasive surface.

The ultra-hard material will typically comprise diamond or cubic boron nitride particles. The thermoplastic polymer is preferably selected from one or more of the following polymers:

Polyetheretherketone (PEEK) such as that marketed by ICI under the trade name VICTREX®.

Poly (amide-imide) such as that marketed by Amoco under the trade name TORLON®.

Polyphenylene sulphide (PPS) such as that marketed by Phillips under the trade name RYTON®.

Liquid crystal polymer (LCP) such as that marketed by Hoechst under the trade name VECTRA®.

In a case where the ultra-hard particles are diamond particles, the particles will usually have a size in the range 2 micron to 300 micron. Also, the particles will usually be present in the abrasive body in an amount of 3% to 30%, preferably 3% to 10%, by volume.

The recesses can be in the form of narrow capillary passages extending perpendicularly to the polishing surface. The passages will typically be round in cross-section with a diameter of approximately 50 micron.

In the preferred application, the carrier is in the form of a rotatable polishing head and a plurality of abrasive polishing pads is mounted on the polishing head. The abrasive body is in the form of an abrasive layer mounted on a base, and the base is also made of a thermoplastic polymer. The abrasive layer and the base may have complemental, interengaged projections and recesses that secure the layer to the base. Alternatively, the abrasive layer may be attached to the base by an overmoulding process. Either or both of the abrasive body and the base can incorporate a colourant which identifies the abrasive capacity of the ultra-hard abrasive particles.

Another aspect of the present invention provides a polishing pad which is adapted to be mounted on a rotatable polishing head and which comprises an abrasive layer which is provided by a thermoplastic polymer impregnated with ultra-hard particles, and a base on which the abrasive layer is mounted, the abrasive layer presenting a polishing surface and including a regular array of recesses therein which extend to the polishing surface.

BRIEF DESCRIPTION OF THE DRAWINGS

The invention will now be described in more detail, by way of example only, with reference to the accompanying drawings in which.

DESCRIPTION OF EMBODIMENTS

Figure 1:
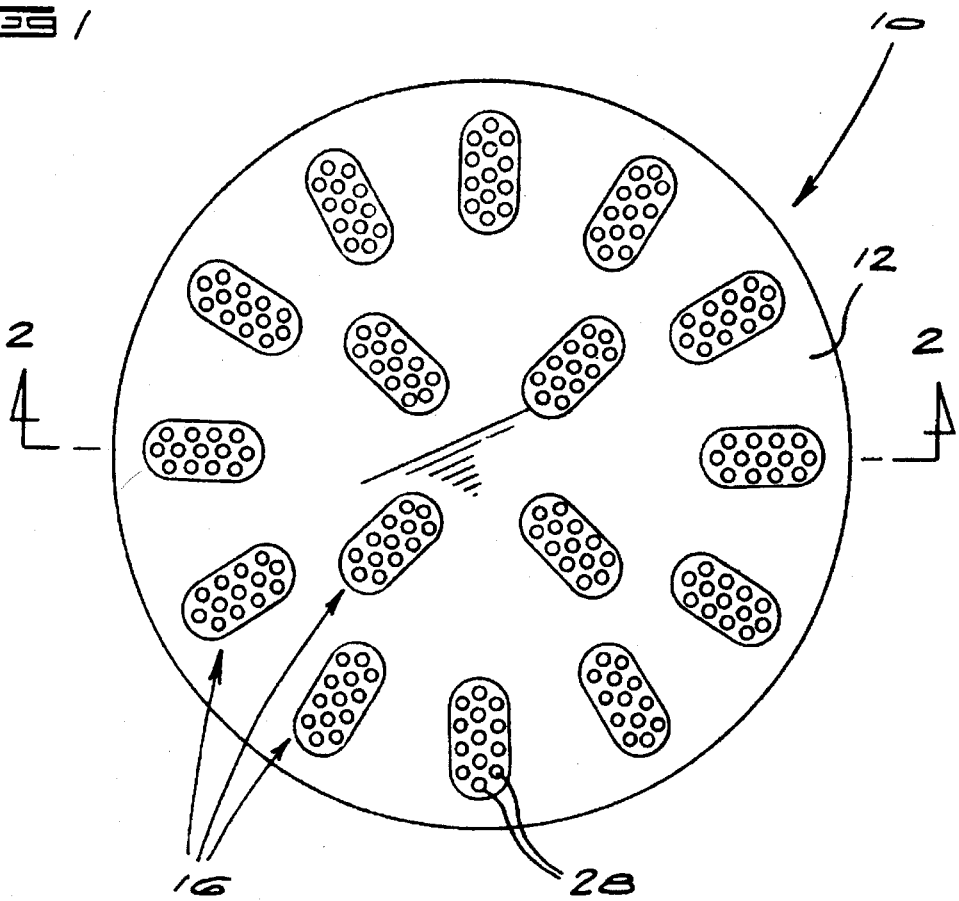
FIG. 1 shows an axial view of an abrasive device.
Figure 2:
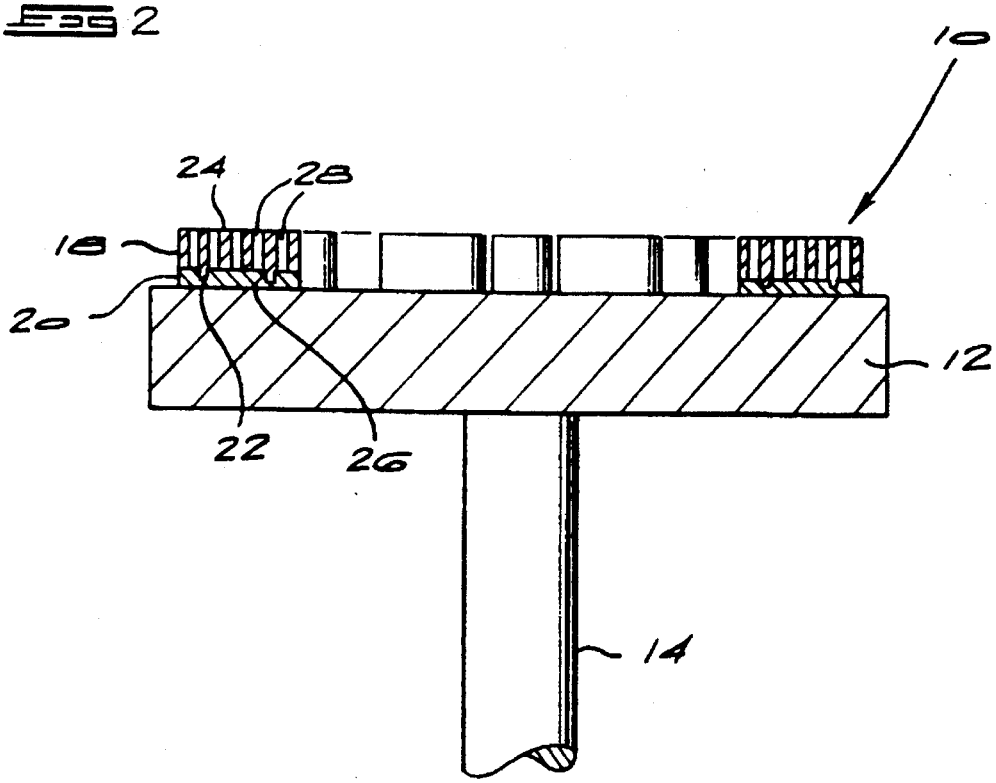
FIG. 2 shows an enlarged cross-section at the line 2—2 in FIG. 1.

The illustrated abrasive device is a polishing apparatus which is used to polish a surface of a body of material such as granite or marble. The polishing apparatus includes a polishing head 10 in the form of a circular steel plate 12. The plate 12 is mounted on a central, rotatable shaft 14.

A number of polishing pads 16 are secured to the surface of the plate 12. Each polishing pad 16 consists of an abrasive body in the form of an abrasive layer 18 mounted on a base 20. The abrasive layer 18 is provided by a suitable thermoplastic polymer, typically PEEK, impregnated with ultra-hard abrasive particles. The particles will usually be diamond or cubic boron nitride particles. The abrasive layer 18 is formed with a series of projections 22 extending from the surface remote from the polishing surface 24.

Each base 20 is also made of a thermoplastic polymer, which will in most cases be different from that used in the layer 18. The base is formed with a series of recesses 26 complemental in shape and position to the projections 22 of the layer 18. In practice, the layer 18 is secured to the base 20 by an interference fit of the projections in the recesses, by thermal bonding of the projections into the recesses, or by..ultrasonic welding of the projections in the recesses.

In a typical case, the pads 16 have a thickness of between 5 mm and 20 mm. They may be fixed to the surface of the plate 12 in any conventional manner.

As illustrated, the abrasive layer 18 is in each case formed with a regular array of recesses communicating with the polishing surface 24. In the illustrated embodiment, these recesses are in the form of narrow capillary passages 28 that extend for the full thickness of the layer 18 but which are nevertheless blind because of the presence of the base. The passages are generally circular in cross-section and it will be noted that they extend perpendicularly to the polishing surface 24. In a typical case, the passages have a diameter of around 50 micron.

In practice, the polishing head 10 is rotated and pressed against a surface which is to be polished by abrasive action. The polishing action is performed by the abrasive layers 18, which will of course wear down with use. However, given that the layers 18 have a fairly substantial thickness, it is not considered necessary to align the polishing surfaces 24 with one another very accurately at the outset.

Should some of the polishing surfaces 24 initially protrude further from the polishing head than others, those surfaces will wear down preferentially, at a rapid rate, until all the surfaces are level, i.e. until the polishing head is properly "bedded in".

The presence of the capillary passages 28 is considered to be advantageous for the reason that they can promote greater freedom in the abrasive cutting action performed by the abrasive particles. Furthermore the passages allow the coolant which is applied to the polishing zone during polishing to gain access to internal regions of the layer 18 and thereby provide an enhanced cooling function.

According to a preferred feature of the invention, the polymer material of the layer 18, and possibly also that used in the base 20, can incorporate a visible colourant. The purpose of the colourant is to identify the abrasive capacity of the polishing pad 16, and thereby to enable consumers to select the appropriate pads for a particular job without difficulty.

In a case in which the abrasive layer 18 incorporates diamond particles, the particles will typically have a size in the range 2 micron to 300 micron and will occupy 3% to 30% and preferably 3% to 10% by volume of the layer.

The results of two series of tests which have been carried out with polishing pads according to the invention are set out below.

TEST 1

Polishing pads according to the invention where made up with the following specification for use in an automated, stagewise polishing apparatus employed to polish granite samples in Germany.

| PAD NO. | ABRASIVE GRIT | GRIT GRADE | CONCENTRATION |
|---|---|---|---|
| 1 | De Beers Diagloss (Trade Mark) | Medium | 25 |
| 2 | De Beers Diagloss (Trade Mark) | Fine | 20 |
| 3 | De Beers Diagloss (Trade Mark) | Ultra Fine | 15 |

Medium grade diamond grit typically has a diamond particle size of about 90 micron, fine grit a diamond particle size of about 60 micron and ultra fine grit a diamond particle size of about 5 micron. The "concentration" values given in the above table are in accordance with normal usage of the term "concentration" as used in the abrasives industry. In practice, a concentration of 4,4 carats/cm$^3$ corresponds to a concentration value of 100. A concentration value of 25 corresponds to a value of 1,1 carats/cm$^3$. Stated differently, the concentration values of 25,20 and 15 seen in the above table correspond to values of 6,25%, 5% and 3,75% by volume.

In polishing mixed types of granite, the polishing pads achieved lives in excess of 2000 m$^2$. Typical polishing times and resulting granite surface conditions are given in the following table.

| PAD NO. | POLISHING TIME (Mins.) | GLOSS VALUE |
|---|---|---|
| 1 | 10 | 20 |
| 2 | 10 | 26 |
| 3 | 9 | 48 |

It was noted that these results are, in terms of tool life or polishing cost, far superior to those obtainable using conventional abrasives such as silicon carbide. It was also noted that higher gloss values were achievable when the polishing pads were used on black granite and fine grain granite than on coarser grades of granite.

TEST 2

A series of DIAGLOSS (trade mark) impregnated polymer polishing pads were made up for use in a manual, as opposed to automatic, granite polishing apparatus. The polishing pads that were made up included grit ranging from extra coarse (corresponding to a diamond particle size of about 190 micron) at a concentration value of 35 (corresponding to a value of 8,75% by volume), used for the roughing stage, to ultra fine (corresponding to a diamond particle size of 5 micron) at a concentration value of 12 (corresponding to a value of 3% by volume), used for final polishing.

The pads were used to polish granite samples in India. Polishing rates up to 50% faster than the rates achieved for conventional abrasives were observed. Extended pad lives ranging from 450 m$^2$ during the roughing stages to 600 m$^2$ during the final polishing stages were achieved, accompanied by a more consistent polish. The pad life exceeded expectations and was far greater than experienced for conventional abrasive pads.

It is believed that the reason why the results of Test 1 are superior to those of Test 2 lis in the difference between the polishing processes used.

We claim:

1. An abrasive polishing device comprising a carrier and a plurality of level abrasive polishing pads mounted on the carrier in spaced relationship thereon, each pad including an abrasive body which is provided by a thermoplastic polymer impregnated therethrough with ultra-hard abrasive particles and which presents an abrasive polishing surface for performing an abrasive polishing action in use, the abrasive body being formed with a regular array of recesses therein which extend to the abrasive surface.

2. An abrasive polishing apparatus according to claim 1 wherein the ultra-hard material comprises diamond or cubic boron nitride particles.

3. An abrasive polishing apparatus according to claim 2 wherein the thermoplastic polymer is selected from PEEK, poly(amide-imide), polyphenylene sulphide and liquid crystal polymer.

4. An abrasive polishing apparatus according to claim 3 wherein the ultrahard particles are diamond particles with a size in the range 2 micron to 300 micron.

5. An abrasive polishing apparatus according to claim 4 wherein the diamond particles are present in the abrasive body in an amount of 3% to 30% by volume.

6. An abrasive polishing apparatus according to claim 5 wherein the diamond particles are present in the abrasive body in an amount of 3% to 10% by volume.

7. An abrasive polishing apparatus according to claim 1 wherein the recesses are in the form of narrow passages extending perpendicularly to the polishing surface.

8. An abrasive polishing apparatus according to claim 7 wherein the passages are round cross-section capillary passages with a diameter of approximately 50 micron..

9. An abrasive polishing apparatus according to claim 8 wherein the abrasive body is in the form of an abrasive layer mounted on a base.

10. An abrasive polishing apparatus according to claim 9 wherein the base is made of a thermoplastic polymer.

11. An abrasive polishing apparatus according to claim 10 wherein the layer and the base have complemental, interengaged projections and recesses that secure the layer to the base.

12. An abrasive polishing apparatus according to claim 9 wherein either or both of the abrasive body and the base incorporate a colourant which identifies the abrasive capacity of the ultra-hard abrasive particles.

13. A polishing pad which is adapted to be mounted on a rotatable polishing head and which comprises an abrasive layer which is provided by a thermoplastic polymer impregnated therethrough with ultra-hard particles, and a base on which the abrasive layer is mounted, the abrasive layer presenting a polishing surface and including a regular array of recesses therein which extend to the polishing surface.

* * * * *